US008720395B2

(12) United States Patent
Lee et al.

(10) Patent No.: US 8,720,395 B2
(45) Date of Patent: May 13, 2014

(54) VARIABLE COMPRESSION RATIO APPARATUS

(71) Applicant: Hyundai Motor Company, Seoul (KR)

(72) Inventors: Eun Ho Lee, Suwon-si (KR); Jin Kook Kong, Suwon-si (KR); Dong Seok Lee, Suwon-si (KR); Soo Hyung Woo, Yongin-si (KR); Yoonsik Woo, Yongin-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/711,488

(22) Filed: Dec. 11, 2012

(65) Prior Publication Data

US 2014/0020660 A1 Jan. 23, 2014

(30) Foreign Application Priority Data

Jul. 23, 2012 (KR) ..... 10-2012-0079989

(51) Int. Cl.
*F02B 75/04* (2006.01)

(52) U.S. Cl.
USPC ..... 123/48 R; 123/48 B; 123/78 B

(58) Field of Classification Search
CPC .... F02B 75/044; F02B 75/045; F02B 75/048; F01B 1/10
USPC .. 123/48 B, 48 R, 48 AA, 78 B, 78 BA, 78 A
See application file for complete search history.

(56) References Cited

U.S. PATENT DOCUMENTS

| | | | | |
|---|---|---|---|---|
| 5,865,092 | A * | 2/1999 | Woudwyk | 92/216 |
| 8,397,684 | B2 * | 3/2013 | Yang et al. | 123/48 R |
| 2012/0000444 | A1 * | 1/2012 | Yang et al. | 123/48 B |

* cited by examiner

*Primary Examiner* — Noah Kamen
*Assistant Examiner* — Long T Tran
(74) *Attorney, Agent, or Firm* — Morgan, Lewis & Bockius LLP

(57) ABSTRACT

A variable compression ratio apparatus may include a connecting rod having a small end portion having an eccentric bearing installation hole, a large end portion rotatably connected to the crank shaft, and a space portion formed in a longitudinal direction of the connecting rod and communicated with the eccentric bearing installation hole, a piston pin fixedly, an eccentric bearing rotatably engaged to the eccentric bearing installation hole and coupled to the piston pin through a pin installation hole of the eccentric bearing, wherein the piston pin may be offset from a center axis of the eccentric bearing, an eccentric link connected to the eccentric bearing, a variable link rotatably connected to the eccentric link, a control link rotatably connected to the variable link, and a control shaft provided in the control link to rotate the control link, wherein the eccentric link may be rotated within the space portion.

9 Claims, 4 Drawing Sheets

VARIABLE COMPRESSION RATIO APPARATUS

CROSS-REFERENCE TO RELATED APPLICATION

The present application claims priority to Korean Patent Application No. 10-2012-0079989 filed on Jul. 23, 2012, the entire contents of which is incorporated herein for all purposes by this reference,

BACKGROUND OF THE INVENTION

1. Field of the Invention

The present invention relates to a variable compression ratio apparatus and, more particularly, to a variable compression ratio apparatus in which a compression ratio of a mixer in a combustion chamber is varied according to an operational state of an engine.

2. Description of Related Art

In general, heat efficiency of a heat engine is increased when a compression ratio is high, and in case of a spark ignition engine, when an ignition time is advanced to a certain level, heat efficiency is increased. However, when an ignition time of a spark ignition engine is advanced at a high compression ratio, abnormal combustion occurs to damage the engine, so there is a limitation in advancing an ignition time and a corresponding degradation of an output should be tolerated.

A variable compression ratio (VCR) apparatus is an apparatus for changing a compression ratio of a mixer according to an operational state of an engine. According to the VCR apparatus, a compression ratio of a mixer is increased in a low load condition to enhance mileage (or fuel efficiency), and the compression ratio of the mixer is lowered in a high load condition to prevent a generation of knocking and enhance an engine output.

The related art VCR apparatus implements a change in a compression ratio by changing a length of a connecting rod connecting a piston and a crank shaft. In the VCR apparatus, the part connecting the piston and the crack shaft includes several links, directly transmitting combustion pressure to the links. Thus, durability of the links weakens.

Various experimentation results with respect to the related art VCR apparatus revealed that operation reliability is high when a distance between the rank pin and the piston pin is changed by using an eccentric bearing. However, when hydraulic pressure is used to rotate an eccentric bearing, an amount of rotation and an amount of hydraulic outflow of the eccentric bearing of each cylinder are different, result in problems in that a compression ratio of each cylinder is not uniform and a time during which a compression ratio is changed varies according to engine operational conditions.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable compression ratio (VCR) apparatus having advantages of changing a compression ratio of a mixer by installing an eccentric bearing in a small end portion of a connecting rod and rotating the eccentric bearing by using link members.

The present invention has also been made in an effort to provide a variable compression ratio (VCR) apparatus having advantages of making link members move smoothly and simplifying a configuration by forming a space at an inner side of a connecting rod.

In an aspect of the present invention, a variable compression ratio (VCR) apparatus installed in an engine rotating a crank shaft upon receiving combustion power of a mixer from a piston and changing a compression ratio of the mixer may include a connecting rod including a small end portion having an eccentric bearing installation hole and rotatably connected to the piston through the eccentric bearing installation hole, a large end portion rotatably connected to the crank shaft such that the large end portion is eccentrically rotatable with respect to the crank shaft, and a space portion formed in a longitudinal direction of the connecting rod and communicated with the eccentric bearing installation hole of the small end portion, a piston pin fixedly provided in the piston, an eccentric bearing rotatably engaged to the eccentric bearing installation hole of the small end portion and coupled to the piston pin through a pin installation hole of the eccentric bearing, wherein the piston pin is offset from a center axis of the eccentric bearing, an eccentric link having a first end connected to the eccentric bearing, a variable link having a first end rotatably connected to a second end of the eccentric link, a control link having a first end rotatably connected to a second end of the variable link, and a control shaft provided in a second end of the control link to rotate the control link, wherein the eccentric link is rotated within the space portion.

The first end of the elastic link may include a pin insertion hole through which the piston pin passes through.

The first end of the elastic link may include a coupling unit insertion hole formed around the pin insertion hole, wherein the eccentric bearing may include a coupling unit fastening hole formed around the pin installation hole, and wherein a coupling unit connects the eccentric bearing to the eccentric link by passing through the coupling unit fastening hole and the coupling unit insertion hole.

The rotation of the control link according to a rotation of the control shaft rotates the eccentric link through the variable link.

The connecting rod transfers the combustion power of the mixer transferred from the piston, to the crank shaft.

The control shaft rotates the control link, upon being rotated according to driving conditions of the engine.

A plurality of balance weights for reducing rotation vibrations is installed in the crank shaft, wherein the connecting rod, the eccentric link, the variable link, and the control link are disposed between a pair of balance weights.

The eccentric bearing is integrally rotated together with the eccentric link.

The control shaft and the control link are integrally rotated.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
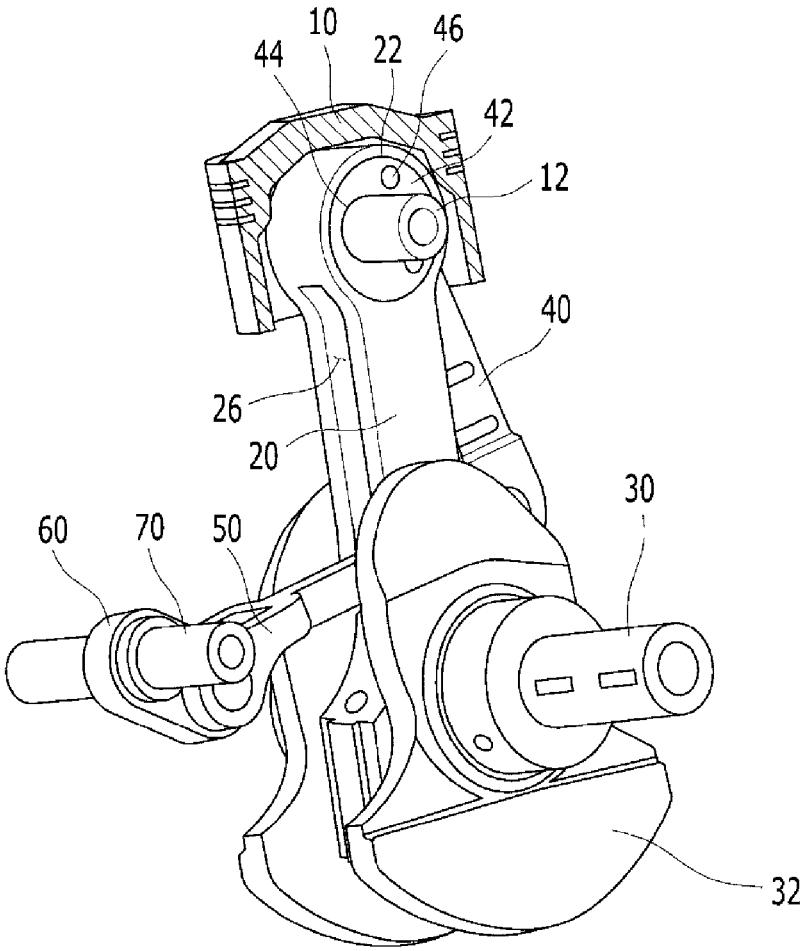
FIG. 1 is a perspective view of a variable compression ratio (VCR) apparatus according to an exemplary embodiment of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

An exemplary embodiment of the present invention will hereinafter be described in detail with reference to the accompanying drawings.

FIG. 1 is a perspective view of a variable compression ratio (VCR) apparatus according to an exemplary embodiment of the present invention.

FIG. 1 shows a section of a piston to illustrate a configuration of a variable compression ratio (VCR) apparatus. Namely, the illustration of the section of the piston is to easily show the configuration in which the VCR apparatus is connected within the piston.

As illustrated in FIG. 1, the VCR apparatus according to an exemplary embodiment of the present invention is installed in an engine that rotates a crank shaft 30 upon receiving combustion power of a mixer from a piston 10, and changes a mixture ratio according to operational conditions of the engine.

The piston 10 makes a vertical movement within a cylinder, and a combustion chamber is formed between the piston 10 and the cylinder.

The crank shaft 30 receives combustion power from the piston 10, converts the combustion power into rotational force, and transfers the rotational force to a transmission (or a gearbox). The crank shaft 30 is installed in a crank case formed in a lower end of the cylinder. Also, a plurality of balance weights 32 are installed in the crank shaft 30. The balance weights 32 reduce vibrations generated when the crank shaft 30 is rotated.

The VCR apparatus according to an exemplary embodiment of the present invention includes a connecting rod 20, an eccentric link 40, an eccentric bearing 42, a variable link 50, a control link 60, and a control shaft 70.

The connecting rod 20 receives combustion power from the piston 10 and transfers the received combustion power to the crank shaft 30. In order to transfer the combustion power, one end of the connecting rod 20 is rotatably connected to the piston 10 by a piston pin 12, and the other end of the connecting rod 20 is eccentrically and rotatably connected to the crank shaft 30. In general, one end portion of the connecting rod 20 connected to the piston 10 is called a small end portion, and the other end portion of the connecting rod 20 connected to the crank shaft 30 is called a large end portion.

The connecting rod 20 includes an eccentric bearing installation hole 22.

The eccentric baring installation hole 22 is formed in the small end portion of the connecting rod 20. The eccentric bearing installation hole 22 has a circular shape to allow the small end portion of the connecting rod 20 to be rotatably connected to the piston 10.

As described above, an overall configuration of the connecting rod 20 is similar to the existing connecting rod 20. Thus, the VCR apparatus may be installed while minimizing a change in the structure of an existing engine.

One end of the eccentric link 40 includes the eccentric bearing 42. The eccentric link 40 and the eccentric bearing 42 may be coupled by a coupling unit 46 such as a pin, or the like. As the eccentric baring 42 is rotatably inserted into the eccentric bearing installation hole 22 of the connecting rod 20, the eccentric link 40 is rotatably connected to the small end portion of the connecting rod 20. In addition, the eccentric bearing 42 is concentrically inserted into the eccentric bearing installation hole 22, and the eccentric bearing 42 may be formed such that an outer diameter thereof is substantially same as an inner diameter of the eccentric bearing installation hole 22.

The eccentric bearing 42 includes a pin installation hole 44.

The pin installation hole 44 is eccentrically formed on the eccentric bearing 42. Also, the piston pin 12 is inserted into the pin installation hole 44 to rotatably connect the connecting rod 20 and the eccentric link 40 to the piston 10. Namely, the coupled eccentric link 40 and the eccentric bearing 42 are rotated based on the center of the piston pin 12, and the center of the piston pin 12 is spaced apart from the center of the eccentric bearing 42 by a certain distance.

When the eccentric bearing 42 is rotated, a relative position of the piston pin 12 with respect to the center of the eccentric bearing 42 is changed. Namely, a relative position of the piston 10 with respect to the connecting rod 20 and the crank shaft 30 is changed. Thus, a compression ratio of the mixer is changed.

The variable link 50 allows the eccentric link 40 to be rotated based on the piston pin 12. Also, one end of the variable link 50 is rotatably connected to the other end of the eccentric link 40.

The control link 60 makes the eccentric link 40 rotate based on the piston pin 12 through the variable link 50. Also, one end of the control ink 60 is rotatably connected to the other end of the variable link 50.

The control shaft 70 is rotated according to operational conditions of the engine, and rotates the control link 60. Namely, the control link 60 is integrally rotated with the control shaft 70 or is rotated according to a rotation of the control shaft 70. Also, the control shaft 70 is provided on the other end of the control link 60, and the control link 60 is rotated based on the control shaft 70.

Meanwhile, the control shaft 70 may be connected to an actuator such as a motor, or the like. Also, an operation of the actuator is controlled by a controller. Namely, the controller determines a compression ratio of the mixer according to an operational state of the engine, and operates the actuator. Thus, according to the operation of the actuator, the control shaft 70 is rotated and the compression ratio of the mixer is changed.

The VCR apparatus according to an exemplary embodiment of the present invention is independently operated, apart from a rotation of the crank shaft 30. Thus, the link members 40, 50, and 60 used in the VCR apparatus may collide with the crank shaft 30. In order to solve such a problem, the connecting rod 20, the eccentric link 40, the variable link 50, and the control link 60 may be disposed between a pair of balance weights 32. Also, a shape of a particular portion of the balance weights 32 may be changed to secure an operational region of the VCR apparatus.

Meanwhile, rotatable connections of the link members 40, 50, and 60 refer to that the link members 40, 50, and 60 are connected through connection units such as pins, or the like, and are relatively rotatable.

Figure 2:
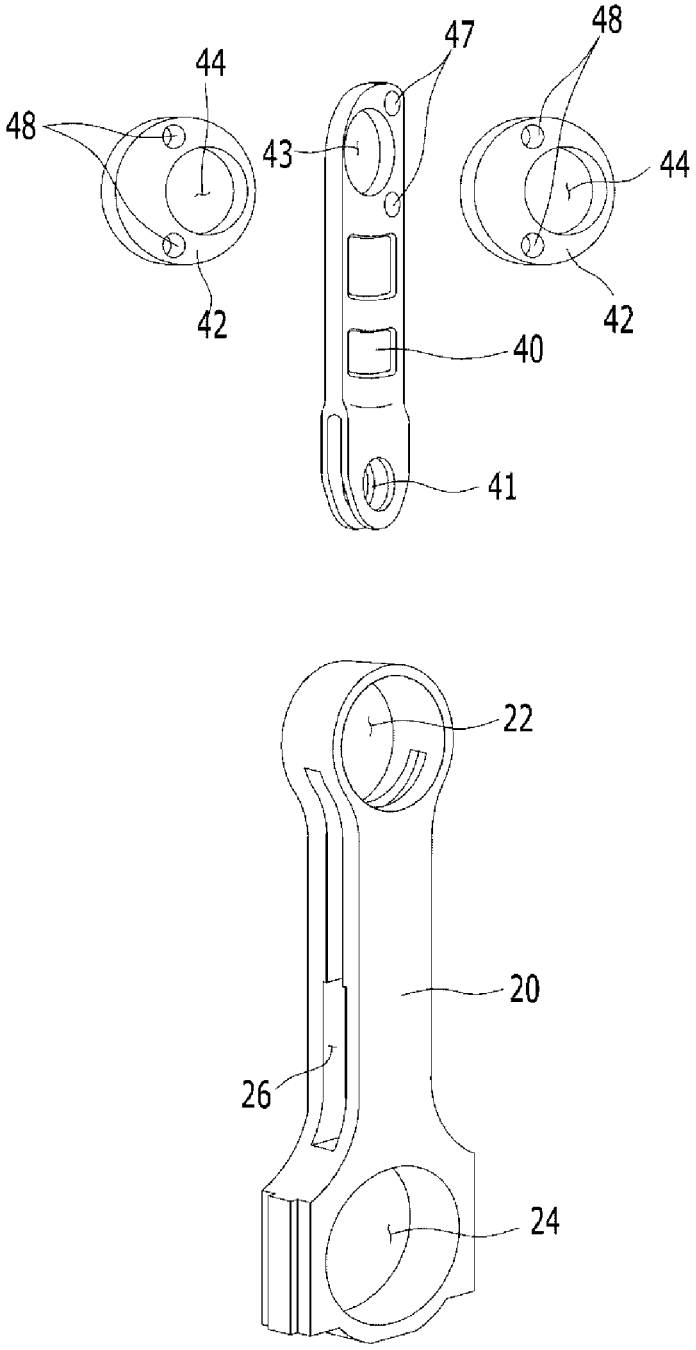
FIG. 2 is an exploded perspective view of the VCR apparatus according to an exemplary embodiment of the present invention.

FIG. 2 is an exploded perspective view of the VCR apparatus according to an exemplary embodiment of the present invention.

FIG. 2 illustrates the configurations of the connecting rod 20, the eccentric link 40, and the eccentric bearing 42 among the components of the VCR apparatus.

As illustrated in FIG. 2, the connecting rod 20 further includes a crank shaft connection hole 24 and a space portion 26, the eccentric bearing 42 further includes coupling unit fastening holes 48, and the eccentric link 40 includes a pin insertion hole 43, coupling unit insertion holes 47, and a variable link connection hole 41.

The crank shaft connection hole 24 is formed in the large end portion of the connecting rod 20. Also, the crank shaft connection hole 24 has a circular shape to allow the large end portion of the connecting rod 20 to be rotatably connected to the crank shaft 30.

The space portion 26 is formed in a longitudinal direction of the connecting rod 20. The space portion 26 extends from the vicinity of the large end portion of the connecting rod 20 to the small end portion of the connecting rod 20, and is connected to the eccentric bearing installation hole 22. Namely, a portion of an inner circumferential surface of the eccentric baring installation hole 22 is open by the space portion 26. The variable link 50 penetrates a lower end portion of the space portion 26. Also, the eccentric link 40 may move within the space portion 26.

The coupling unit fastening hole 48 of the eccentric bearing 42 and the coupling unit insertion hole 47 of the eccentric link 40 are formed at corresponding positions. Namely, the coupling unit 46 is inserted into the coupling unit fastening hole 48 and the coupling unit insertion hole 47 to couple the eccentric bearing 42 and the eccentric link 40. Meanwhile, in FIG. 2, it is illustrated that two coupling unit fastening holes 48 and two coupling unit insertion holes 47 are formed to allowing two coupling units 46 to be inserted therein, but the present invention is not limited thereto.

The pin insertion hole 43 is formed in one end of the eccentric link 40 to which the eccentric bearing 42 is coupled. Also, the pin insertion hole 43 is formed to have the same size and shape as those of the pin installation hole 44 of the eccentric bearing 42. In addition, the piston pin 12 is inserted into the pin installation hole 44 and the pin insertion hole 43.

The variable link connection hole 41 is formed on the other end of the eccentric link 40. Also, the variable link connection hole 41 has a circular shape formed to allow one end of the variable link 50 to be rotatably connected to the other end of the eccentric link 40.

Hereinafter, coupling of the connecting rod 20, the eccentric link 40, and the eccentric bearing 42 will be described in detail with reference to FIGS. 1 and 2.

The eccentric link 40 is inserted to an inner side of the connecting rod 20 through the space portion 26 such that the pin insertion hole 43 is positioned in the eccentric bearing installation hole 22 of the connecting rod 20. Also, the two eccentric bearings 42 illustrated in FIG. 2 are inserted into the eccentric bearing installation hole 22 from both sides of the eccentric bearing installation hole 22.

When the eccentric link 40, the connecting rod 20, and the two eccentric bearing 42 are positioned as mentioned above, the coupling unit 46 is fastened sequentially through the coupling unit fastening hole 48 of one eccentric bearing 42, the coupling unit insertion hole 47, and the coupling unit fastening hole 48 of the other eccentric bearing 42.

Through such coupling, the eccentric link 40 passes through the space portion 26 formed in the connecting rod 20 so as to be disposed to be rotatable based on the piston pin 12. Also, the variable link 50 connected to the eccentric link 40 moves, while passing through the space portion 26 according to a rotation of the eccentric link 40. Thus, a space required for an operation of the VCR apparatus can be reduced, and the configuration of the VCR apparatus can be simplified.

The operation of the VCR apparatus according to an exemplary embodiment of the present invention will be described in detail with reference to FIG. 3.

Figure 3:
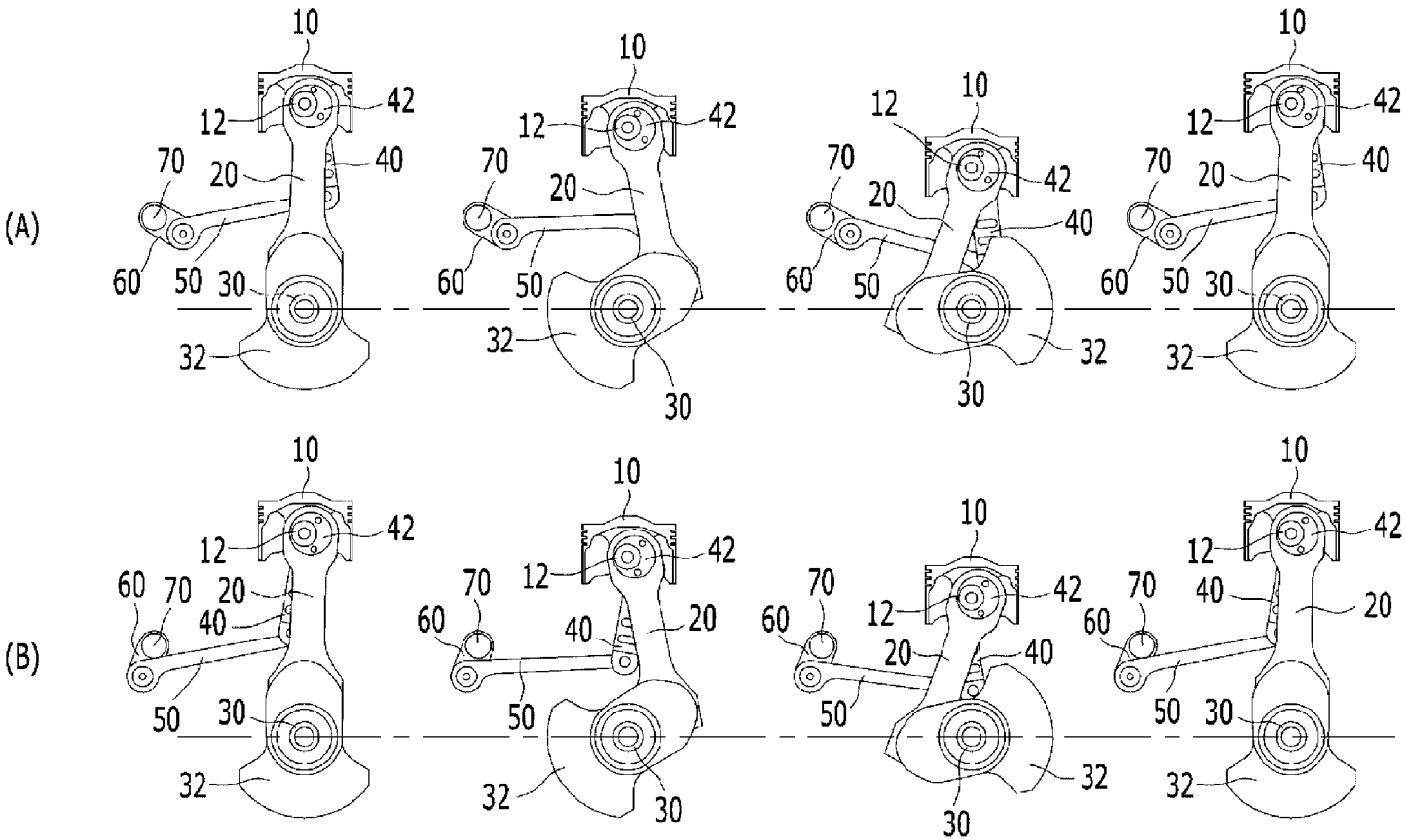
FIG. 3 is a view illustrating operations of the VCR apparatus in a low compression ratio and a high compression ratio according to an exemplary embodiment of the present invention.

FIG. 3 is a view illustrating operations of the VCR apparatus in a low compression ratio and a high compression ratio according to an exemplary embodiment of the present invention.

As illustrated in FIG. 3(A), in a state in which the engine is operated at a low compression ratio, when the control shaft 70 is rotated in a clockwise direction, the control link 60 is rotated in the clockwise direction together with the control shaft 70, pulling the variable 50. Accordingly, the eccentric link 40 and the eccentric baring 42 are rotated in the clockwise direction, and the position of piston pin 12 is lifted. Namely, a relative position of the piston 10 with respect to the connecting rod 20 and the crank shaft 30 is raised. Thus, a distance between the piston pin 12 and a crank pin is increased, implementing a high compression ratio operational state of the engine illustrated in FIG. 3(B).

As illustrated in FIG. 3(B), in a state in which the engine is operated in a high compression ratio, when the control shaft 70 is rotated in a counterclockwise direction, the control link 60 is rotated in the counterclockwise direction together with the control shaft 70, pushing the variable link 50. Accordingly, the eccentric link 40 and the eccentric baring 42 are rotated in the counterclockwise direction, and the position of the piston pin 12 is lowered. Namely, a relative position of the piston 10 with respect to the connecting rod 20 and the crank shaft 30 is lowered. Thus, the distance between the piston pin 12 and the crank pin is decreased, implementing a low compression ratio operational state of the engine illustrated in FIG. 3(A).

Figure 4:
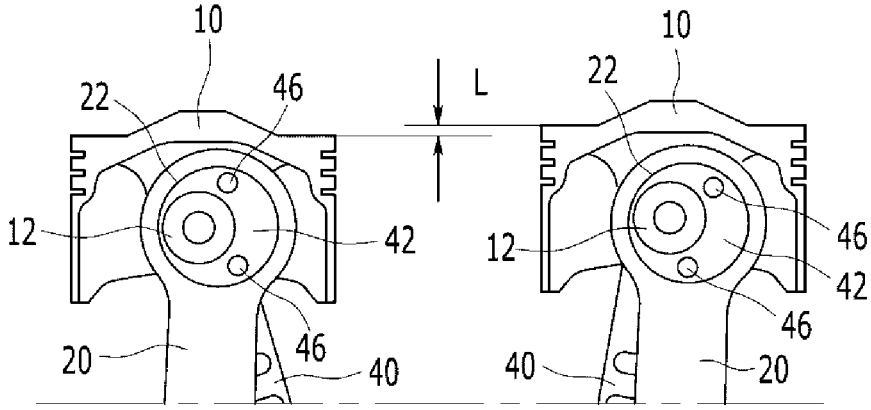
FIG. 4 is a schematic view illustrating a comparison between positions of a piston in a low compression ratio and a high compression ratio according to an exemplary embodiment of the present invention.

FIG. 4 is a schematic view illustrating a comparison between positions of a piston in a low compression ratio and a high compression ratio according to an exemplary embodiment of the present invention.

In the VCR apparatus in which the engine is rotated in a low compression ratio state, when the control shaft 70 is rotated in the clockwise direction, the positions of the piston pin 12 and the piston 10 are raised by a pre-set height L by the control link 60, the variable link 50, and the eccentric link 40. Accordingly, a high compression ratio of the mixer is implemented.

Conversely, in the VCR apparatus in which the engine is rotated in a high compression ratio state, when the control shaft 70 is rotated in the counterclockwise direction, the positions of the piston pin 12 and the piston 10 are lowered by a pre-set height L by the control link 60, the variable link 50, and the eccentric link 40. Accordingly, a low compression ratio of the mixer is implemented.

As described above, according to the exemplary embodiments of the present invention, by changing the compression ratio of the mixer according to an operational state of the engine by using the VCR apparatus having a simple configuration, while making the link members 40, 50, and 60 move smoothly, an operation time for installing the VCR apparatus and production cost can be reduced and a mileage (or fuel efficiency) can be enhanced. Also, by using the connecting rod 20 applicable to an existing engine, the VCR apparatus can be installed, while minimizing a change in the structure of the existing engine.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable compression ratio (VCR) apparatus installed in an engine rotating a crank shaft upon receiving combustion power of a mixer from a piston and changing a compression ratio of the mixer, the apparatus comprising:

a connecting rod including:

a small end portion having an eccentric bearing installation hole and rotatably connected to the piston through the eccentric bearing installation hole;

a large end portion rotatably connected to the crank shaft such that the large end portion is eccentrically rotatable with respect to the crank shaft; and a space portion formed in a longitudinal direction of the connecting rod and communicated with the eccentric bearing installation hole of the small end portion;

a piston pin fixedly provided in the piston;

an eccentric bearing rotatably engaged to the eccentric bearing installation hole of the small end portion and coupled to the piston pin through a pin installation hole of the eccentric bearing, wherein the piston pin is offset from a center axis of the eccentric bearing;

an eccentric link having a first end connected to the eccentric bearing;

a variable link having a first end rotatably connected to a second end of the eccentric link;

a control link having a first end rotatably connected to a second end of the variable link; and a control shaft provided in a second end of the control link to rotate the control link, wherein the eccentric link is rotated within the space portion.

2. The VCR apparatus of claim 1, wherein the first end of the elastic link includes a pin insertion hole through which the piston pin passes through.

3. The VCR apparatus of claim 2, wherein the first end of the elastic link includes a coupling unit insertion hole formed around the pin insertion hole, wherein the eccentric bearing includes a coupling unit fastening hole formed around the pin installation hole, and wherein a coupling unit connects the eccentric bearing to the eccentric link by passing through the coupling unit fastening hole and the coupling unit insertion hole.

4. The VCR apparatus of claim 1, wherein the rotation of the control link according to a rotation of the control shaft rotates the eccentric link through the variable link.

5. The VCR apparatus of claim 1, wherein the connecting rod transfers the combustion power of the mixer transferred from the piston, to the crank shaft.

6. The VCR apparatus of claim 1, wherein the control shaft rotates the control link, upon being rotated according to driving conditions of the engine.

7. The VCR apparatus of claim 1, wherein a plurality of balance weights for reducing rotation vibrations is installed in the crank shaft, and wherein the connecting rod, the eccentric link, the variable link, and the control link are disposed between a pair of balance weights.

8. The VCR apparatus of claim 1, wherein the eccentric bearing is integrally rotated together with the eccentric link.

9. The VCR apparatus of claim 1, wherein the control shaft and the control link are integrally rotated.

* * * * *